United States Patent [19]

Iwasa

[11] 4,029,066

[45] June 14, 1977

[54] CARBURETOR

[75] Inventor: Yoshio Iwasa, Nagareyama, Japan

[73] Assignee: Nissan Motor Co., Ltd., Yokohama, Japan

[22] Filed: June 24, 1975

[21] Appl. No.: 589,904

[30] Foreign Application Priority Data

July 9, 1974 Japan ..... 49-77900

[52] U.S. Cl. ..... 123/127; 123/32 SP; 123/75 B; 123/191 S; 261/23 A; 261/65

[51] Int. Cl.[2] ..... F02M 13/06

[58] Field of Search ..... 123/32 R, 32 SP, 32 ST, 123/33 D, 33 VC, 75 B, 127, DIG. 4, 191 S, 191 SP; 261/23 A, 44 R, 65, DIG. 68; 251/368

[56] References Cited

UNITED STATES PATENTS

| | | | |
|---|---|---|---|
| 1,259,105 | 3/1918 | Joret | 261/65 |
| 1,893,006 | 1/1933 | Trechsel | 123/75 B |
| 2,453,377 | 11/1948 | Lozivit | 123/75 B |
| 2,789,547 | 4/1957 | Mallory | 123/75 B |
| 3,092,088 | 6/1963 | Goossak et al. | 123/32 ST |
| 3,283,751 | 11/1966 | Goossak et al. | 123/32 ST |
| 3,746,320 | 7/1973 | Van Camp et al. | 261/DIG. 68 |
| 3,796,228 | 3/1974 | Bedo et al. | 251/368 |
| 3,863,889 | 2/1975 | Robinson et al. | 251/368 |
| 3,884,197 | 5/1975 | Miyaki et al. | 123/32 ST |

FOREIGN PATENTS OR APPLICATIONS

| | | | |
|---|---|---|---|
| 1,257,050 | 2/1961 | France | 261/DIG. 68 |
| 1,451,645 | 1/1969 | Germany | 123/32 ST |

*Primary Examiner*—C. J. Husar
*Assistant Examiner*—David D. Reynolds

[57] ABSTRACT

An internal combustion engine has a main combustion chamber and an auxiliary combustion chamber which is connected to the main combustion chamber by way of a torch nozzle. A main carburetor communicates with the main combustion chamber to supply a large amount of lean combustible mixture, and an auxiliary carburetor communicates with the auxiliary combustion chamber to supply a small amount of rich combustible mixture. A rotary valve is disposed within the auxiliary carburetor downstream of its venturi section. The cross sectional area of an opening of the rotary valve is smaller than that of the venturi section.

3 Claims, 4 Drawing Figures

CARBURETOR

The present invention relates to carburetors for internal combustion engines having one or more cylinders each providing a main combustion chamber, and an auxiliary combustion chamber connected to each main chamber through a torch nozzle. Each auxiliary combustion chamber is provided with a spark plug. A lean mixture is supplied to each main chamber and a rich mixture is supplied to each auxiliary chamber.

Conventional carburetors which furnish a rich mixture to an auxiliary combustion chamber and a lean mixture to a main combustion chamber connected to the auxiliary combustion chamber through a torch nozzle are so constructed as to provide careful regulation and control of air weight or quantity induced into each auxiliary chamber as compared to air weight or quantity induced into each main chamber. The ratio of the air weight induced into the auxiliary chamber to that induced into the main chamber is controlled within a certain range by an auxiliary throttle valve of the butterfly type and at least one main throttle valve operatively connected to the auxiliary throttle valve by a control linkage.

The quantity of rich mixture supplied to the auxiliary chamber is extremely small in comparison with that which is supplied into the main chamber. Preferably, the ratio of the quantity of rich mixture supplied to the auxiliary chamber to that which is supplied into the main chamber ranges from 1/15 to 1/50. Moreover, the air-fuel ratio of the mixture supplied to the auxiliary chamber is considerably rich. Accordingly, even a small variation in the amount of air has a great effect on the quantity and quality of the mixture admitted into the auxiliary chamber. It is thus required that the air weight induced into the auxiliary chamber be carefully controlled so that the above-mentioned ratio may be kept within the range constantly.

The conventional carburetor includes a main carburetor which furnishes a lean mixture to the main chamber and an auxiliary carburetor which furnishes a rich mixture to the auxiliary chamber. The main carburetor is usually designed for the purpose of reducing the flow resistance at the full throttle operation in such a manner that the opening of a throttle valve in each induction passage at the fully open throttle position is larger, in cross sectional area, than a throat of a venturi in the induction passage. The auxiliary carburetor is designed in the same manner that the opening of a throttle valve at the full throttle position is larger, in cross sectional area, than a throat of a venturi in an induction passage. In designing the auxiliary carburetor, it is desired that the variation of air weight induced to the auxiliary chamber responsive to the variation of the throttle valve position be small. As a result, even if there is available the loose and/or manufacturing tolerance of the component parts of the control of the throttle valve in the auxiliary carburetor, the effect on variation of air weight due to such loose and/or manufacturing tolerance becomes negligible. The fact that the sharp variation of air weight responsive to the variation of the throttle position is unnecessary in the case of the auxiliary carburetor will be understood by recognizing that the rich mixture supplied into the auxiliary chamber is combusted to provide a torch flame to be injected into the main chamber through a torch nozzle and not to produce power output.

One proposal to reduce the variation of air weight induced into the auxiliary chamber is to make the cross sectional area of the throat of venturi as small as possible to reduce air flow therethrough. If the cross sectional area of the throat of the venturi in the auxiliary carburetor is reduced, the feed of fuel through a main jet opening into the throat is not smooth because the main jet is correspondingly reduced in size. This is particularly true when the speed of air flow through the throat increases during the full throttle operation mode, and a high degree of vacuum is created in the induction passage at a portion in the vicinity of a slow port due to the high speed flow, with the result that ambient air enters into the induction passage through an air bleed and the feed of fuel into the throat through the main jet is considerably reduced, this phenomenon being often called as "back bleed phenomenon".

It is accordingly an object of the present invention to provide a carburetor of the above character which eliminates the "back bleed phenomenon".

Based on the recognition that the back bleed phenomenon will occur during the full throttle operating condition of the engine, it is a specific object of the present invention to provide an internal combustion engine comprising a main combustion chamber; an auxiliary combustion chamber; a torch nozzle establishing communication between the chambers; a main carburetor communicating with the main combustion chamber for supplying a relatively lean combustible mixture to the main combustion chamber; an auxiliary carburetor communicating with the auxiliary combustion chamber for supplying a relatively rich combustible mixture to the auxiliary combustion chamber, the auxiliary carburetor having an induction passage provided with a venturi forming a throat, and a rotary valve rotatably disposed in the induction passage downstream of the venturi with respect to flow of air through the induction passage, the rotary valve having an opening extending therethrough the cross sectional area of the opening of the rotary valve being smaller than the cross sectional area of the throat of the venturi and means for igniting the relatively rich combustible mixture in the auxiliary combustion chamber to project a flame through the torch nozzle.

It is another object of the present invention to provide an internal combustion engine of the above character in which the rate of wear of the rotary valve is small.

It is still another object of the present invention to provide an internal combustion engine of the above character in which the accuracy in forming the throat in the venturi is increased.

Other objects and advantages of the present invention will become clear hereinafter as the description progresses with reference to the accompanying drawings, in which.

Figure 1:
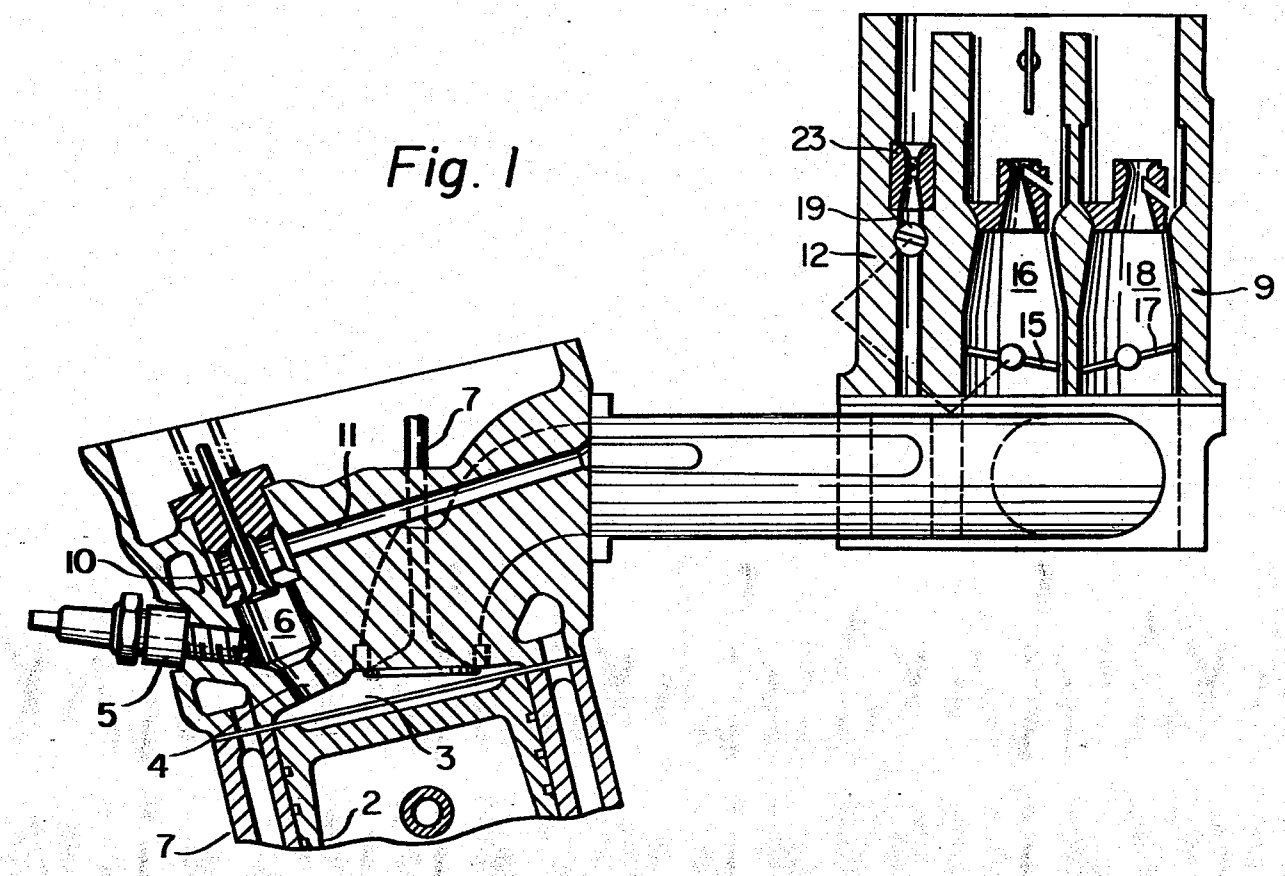
FIG. 1 is a sectional elevation showing a preferred embodiment of an internal combustion engine of the invention.

Referring to the drawings, the internal combustion engine 1 has one or more pistons 2 each forming one wall of a main combustion chamber 3. A torch nozzle 4 establishes communication between the auxiliary combustion chamber 6 and the main combustion chamber 3, and this auxiliary combustion chamber 6 is provided with a spark plug 5. The main combustion chamber 3 is supplied with a lean combustible mixture from a main carburetor 9 through a main inlet passage 8 having a main inlet valve 7. The auxiliary combustion chamber 6 is supplied with a rich combustible mixture from auxiliary carburetor 12 through an auxiliary inlet passage 11 having an auxiliary inlet valve 10. Flow through the exhaust passage (not shown) from the main combustion chamber 3 is controlled by the exhaust valve (not shown).

The main carburetor 9 and the auxiliary carburetor 12 are integrated into a single assembly, and the main carburetor 9 is of compound type having a primary main induction passage 16 with a primary throttle valve 15, and a secondary main induction passage 18 with a secondary main throttle valve 17. The auxiliary carburetor 12 has a single auxiliary induction passage 20 controlled by an auxiliary throttle valve 19 which is a rotary valve.

Figure 2:
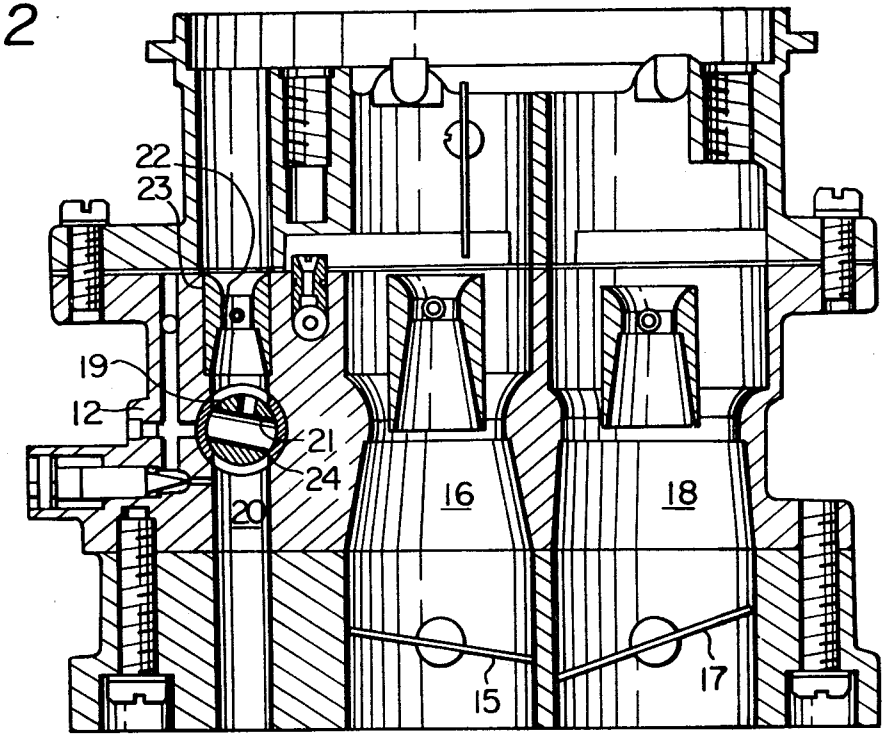
FIG. 2 is a transverse sectional view showing details of construction of the carburetor shown in FIG. 1.
Figure 3:
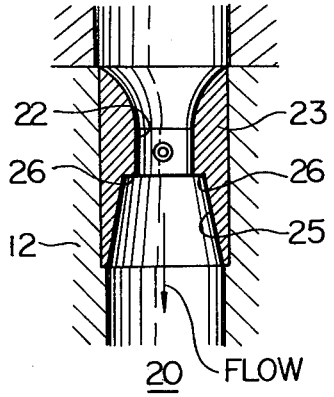
FIG. 3 is an enlarged view of a venturi of the auxiliary carburetor shown in FIG. 2.

In accordance with the present invention the cross sectional area of an opening 21 extending through the rotary valve 19 is smaller than that of a throat 22 of a venturi 23 of the auxiliary carburetor 12, as best seen in FIGS. 2 and 3.

Another feature of the present invention is that a bush 24 is inserted between a carburetor body and the rotary valve 19 to increase accuracy of metering in the auxiliary carburetor 12 and the bush 24 and the rotary valve 19 are made of stainless steel to reduce the rate of wear. The result from this feature is that looseness of the rotary valve during operation is prevented and the variation of air weight induced through the auxiliary carburetor 12 responsive to a given throttle opening is reduced as compared to the case in which the rotary valve and the bush are made of an alloy including alumina or zinc. When such alloy is used the rate of wear between contacting surfaces of the rotary valve and the bush is relatively high.

Still another feature of the present invention is that a flaring section 25 of the venturi 23 diverging in a downstream direction, with respect to air flow through the auxiliary carburetor induction passage 20 is connected to the throat 22 by an annular shoulder 26 directed in the downstream direction. The result is that the accuracy, in dimension, of the throat 22 of the venturi 23 is increased because the work of finishing the throat 22 is assured.

Figure 4:
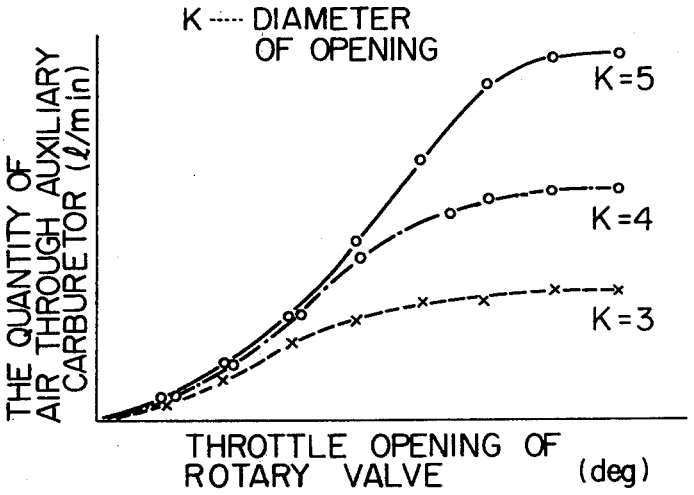
FIG. 4 is a graph in which each of three curves shows the variation of the air quantity through the auxiliary carburetor responsive to the variation of the throttle opening, and the curves correspond to different diameters of the opening extending through the rotary valve, respectively.

It will be confirmed from FIG. 4 that reducing the diameter (K) of the opening 21 of the rotary valve 19 will result in the reduction in the variation of the quantity of air induced through the auxiliary carburetor 12 responsive to the variation of the throttle opening. It will therefore be appreciated that the variation of air quantity induced through the auxiliary carburetor 12 responsive to the throttle opening is small. This means that the effect of the loose available or the manufacturing tolerance on the variation of air quantity induced through the auxiliary carburetor 12 is decreased. This is advantageous in that the accuracy in metering by any one auxiliary carburetor selected from the carburetors manufactured on mass production basis is improved.

It will also be appreciated that the back bleed phenomenon is eliminated by the present invention, with the result that accurate metering of fuel is possible through all operating modes.

What is claimed is:

1. An internal combustion engine comprising:
a cylinder head;
a cylinder closed off by said cylinder head;
a piston within said cylinder;
a main combustion chamber formed within said cylinder between said cylinder head and said piston;
an auxiliary combustion chamber;
a torch nozzle establishing communications between said chambers;
a main carburetor communicating only with said main combustion chamber for supplying a relatively lean combustible mixture only to said main combustion chamber;
an auxiliary carburetor communicating only with said auxiliary combustion chamber for supplying a relatively rich combustible mixture only to said auxiliary combustion chamber, said auxiliary carburetor having an induction passage communicating only with said auxiliary combustion chamber and provided with a venturi forming a throat, and a rotary valve rotatably disposed in said induction passage downstream of said venturi with respect to flow of air through said induction passage, said rotary valve having an opening extending therethrough, the cross sectional area of said opening of said rotary valve being smaller than the cross sectional area of said throat of said venturi, whereby there is a reduction of the variation of air quantity induced into the auxiliary combustion chamber through the auxiliary carburetor responsive to the variation of the throttle opening; and
means for igniting the relatively rich combustible mixture in said auxiliary combustion chamber to project a flame through said torch nozzle.

2. An internal combustion engine as claimed in claim 1, in which said auxiliary carburetor further comprises a bush inserted between a body defining the induction passage and the rotary valve, and in which the bush and the rotary valve are made of a stainless steel.

3. An internal combustion engine as claimed in claim 1, in which a flaring section of the venturi deverging in a downstream direction is connected to the throat by an annular shoulder directed in the downstream direction.

* * * * *